US007070396B2

(12) United States Patent
Yamauchi et al.

(10) Patent No.: US 7,070,396 B2
(45) Date of Patent: Jul. 4, 2006

(54) OIL PUMP APPARATUS HAVING OIL DRAIN

(75) Inventors: Kentaro Yamauchi, Okazaki (JP); Atsushi Eto, Okazaki (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 425 days.

(21) Appl. No.: 10/464,561

(22) Filed: Jun. 19, 2003

(65) Prior Publication Data

US 2004/0208755 A1 Oct. 21, 2004

(30) Foreign Application Priority Data

Jun. 19, 2002 (JP) ..... 2002-178322

(51) Int. Cl.
*F04B 49/00* (2006.01)
*F01M 1/00* (2006.01)

(52) U.S. Cl. ..... 417/310; 418/268; 184/6.16

(58) Field of Classification Search ..... 417/310; 418/268, 269; 184/6.16
See application file for complete search history.

(56) References Cited

U.S. PATENT DOCUMENTS 5,154,593 A * 10/1992 Konishi et al. ..... 418/77
6,375,441 B1 * 4/2002 Ichizuki et al. ..... 418/30
6,877,961 B1 * 4/2005 Fujiwara et al. ..... 417/310

* cited by examiner

*Primary Examiner*—Charles G. Freay
(74) *Attorney, Agent, or Firm*—Oblon, Spivak, McClelland, Maier & Neustadt, P.C.

(57) ABSTRACT

In an oil pump apparatus, a drain outlet is positioned outwardly from an inner peripheral surface of a suction passage or from an extended line thereof at a sectional view which takes along an orthogonal direction relative to a central axis of the suction passage and which shows the drain outlet, and/or the drain outlet is positioned at a side of a shaft aperture to be away from an imaginary line connecting a central axis of a discharged passage and a central axis of the suction passage at a sectional view which takes in parallel with the central axis of suction passage and which shows the drain outlet, such that the opening center of the drain outlet is not overlapped on the imaginary line.

20 Claims, 7 Drawing Sheets

OIL PUMP APPARATUS HAVING OIL DRAIN

CROSS REFERENCE TO RELATED APPLICATIONS

This application is based on and claims priority under 35 U.S.C. § 119 with respect to a Japanese Patent Application 2002-178322, filed on Jun. 19, 2002, the entire content of which is incorporated herein by reference.

FIELD OF THE INVENTION

This invention generally relates to an oil pump apparatus. For example, the oil pump apparatus is applicable for supplying an oil pressure to a vehicle power steering device.

BACKGROUND OF THE INVENTION

A vehicle oil pump apparatus disclosed in a Japanese Utility Model Application published as No. 1993-96483 is provided with a base portion, a rotor acting as a pump, a drive shaft, and a sealing member. The base portion includes an operating chamber, a shaft aperture, a suction port, a discharging port, a suction passage supplying an oil to the suction port, and a discharged passage discharged with the oil from the discharging port. The rotor is disposed in the operating chamber for its rotation and acting as the pump introducing the oil in the suction passage to the suction port and supplying the oil to the discharged passage via the discharging port. The drive shaft is disposed in the shaft aperture for its rotation so as to rotate the rotor. The sealing member is disposed in a boundary between an outer peripheral surface of the drive shaft and an inner peripheral surface of the shaft aperture so as to seal the boundary. A flow control valve is disposed in the discharged passage so as to return an excess oil to the suction passage in response to operation thereof.

Both ends of the rotor possess a predetermined clearance between adjacent members thereof and are sildaly in contact therewith via oil films. In the aforementioned structure, the oil may leak from the contact surfaces to the drive shaft. The leaked oil is guided to the sealing member from the outer periphery of the drive shaft and is returned to the suction passage via a drain bore defined in the base portion. The drain bore includes a drain inlet communicating with the shaft aperture, a drain outlet communicating with the suction passage, and a drain connecting passage for connecting the drain inlet and the drain outlet. An opening diameter of the drain outlet is designed to be small in light of an inner structure of the oil pump apparatus, an wall thickness of the base portion and the like.

In the above-described oil pump apparatus, while the pump apparatus is running the oil leaked at the outer periphery of the drive shaft is introduced by the drain inlet and drained from the drain outlet to the suction passage maintained at a relatively low pressure level.

Recent developments have led to increasing pressure generated by the oil pump apparatus and increasing an amount of oil discharged therefrom. Especially in accordance with these recent technological developments, the oil may be returned to the suction passage at a relatively large amount in response to the operation of the flow control valve. In this case, the return oil flow speed may become relatively high. This may cause deterioration of oil drain performance for draining the oil from the drain outlet, wherein the space sealed with the sealing member may be unnecessarily applied with a high pressure. Therefore, there may be concern that the seal lip portion of the sealing member may wear out earlier than expected and the sealing member may be dropped off.

There is a need to provide an improved oil pump apparatus capable of assuring the oil drain performance for draining the oil from the drain outlet and capable of reducing the wear-out of the sealing member even if the oil pressure and the oil amount from the oil pump apparatus has been increased.

SUMMARY OF THE INVENTION

In light of the foregoing, according to an aspect of the present invention, an oil pump apparatus includes a base portion, a rotating means, a drive shaft, a sealing means, and a drain bore. The base portion includes an operating chamber, a shaft aperture, a suction port, a discharging port, a suction passage supplying an oil to the suction port, and a discharged passage discharged with the oil from the discharging port. The rotating means is disposed in the operating chamber for its rotation, acts as a pump introducing the oil in the suction passage to the operating chamber via the suction port, and supplied the oil to the discharged passage via the discharging port. The drive shaft is disposed in the shaft aperture for its rotation so as to rotate the rotating means. The sealing means is disposed in a boundary between an outer peripheral surface of the drive shaft and an inner peripheral surface of the shaft aperture so as to seal the boundary.

The drain bore includes a drain inlet communicating with the shaft aperture, a drain outlet communicating with the suction passage, and a drain connecting passage connecting the drain inlet and the drain outlet. An excess oil in the shaft aperture is introduced from the drain inlet for draining the oil and is drained from the drain outlet via the drain connecting passage. An opening center of the drain outlet is positioned outwardly from an inner peripheral surface of the suction passage or from an extended line of the inner peripheral surface somewhere around the opening center of the drain outlet exists so as to take along an orthogonal direction relative to a central axis of the suction passage.

According to another aspect of the present invention, an oil pump apparatus includes a base portion, a rotating means, a drive shaft, a sealing means, and a drain bore. The base portion includes an operating chamber, a shaft aperture, a suction port, a discharging port, a suction passage supplying an oil to the suction port, and a discharged passage discharged with the oil from the discharging port. The rotating means is disposed in the operating chamber for its rotation, acts as a pump introducing the oil in the suction passage to the operating chamber via the suction port, and supplied the oil to the discharged passage via the discharging port. The drive shaft is disposed in the shaft aperture for its rotation so as to rotate the rotating means. The sealing means is disposed in a boundary between an outer peripheral surface of the drive shaft and an inner peripheral surface of the shaft aperture so as to seal the boundary.

The drain bore includes a drain inlet communicating with the shaft aperture, a drain outlet communicating with the suction passage, and a drain connecting passage connecting the drain inlet and the drain outlet. An excess oil in the shaft aperture is introduced from the drain inlet for draining the oil and is drained from the drain outlet via the drain connecting passage. An opening center of the drain outlet is positioned at a side of the shaft aperture to be away from an imaginary line connecting a central axis of the discharged passage and a central axis of the suction passage somewhere around the opening center of the drain outlet exits so as to take in parallel with the central axis of the suction passage, such that the opening center of the drain outlet is not overlapped on the imaginary line.

According to still further aspect of the present invention, an oil pump apparatus includes a base portion, a rotating means, a drive shaft, a sealing means, and a drain bore. The base portion includes an operating chamber, a shaft aperture, a suction port, a discharging port, a suction passage supplying an oil to the suction port, and a discharged passage discharged with the oil from the discharging port. The rotating means is disposed in the operating chamber for its rotation, acts as a pump introducing the oil in the suction passage to the operating chamber via the suction port, and supplied the oil to the discharged passage via the discharging port. The drive shaft is disposed in the shaft aperture for its rotation so as to rotate the rotating means. The sealing means is disposed in a boundary between an outer peripheral surface of the drive shaft and an inner peripheral surface of the shaft aperture so as to seal the boundary.

The drain bore includes a drain inlet communicating with the shaft aperture, a drain outlet communicating with the suction passage, and a drain connecting passage connecting the drain inlet and the drain outlet. An excess oil in the shaft aperture is introduced from the drain inlet for draining the oil and is drained from the drain outlet via the drain connecting passage. An opening center of the drain outlet is positioned outwardly from an inner peripheral surface of the suction passage or from an extended line of the inner peripheral surface somewhere around the opening center of the drain outlet exits so as to take along an orthogonal direction relative to a central axis of the suction passage. Further, the opening center of the drain outlet is positioned at a side of the shaft aperture to be away from an imaginary line connecting a central axis of the discharged passage and a central axis of the suction passage somewhere around the opening center of the drain outlet exits so as to take in parallel with the central axis of the suction passage, such that the opening center of the drain outlet is not overlapped on the imaginary line.

BRIEF DESCRIPTION OF THE DRAWING FIGURES

The foregoing and additional features and characteristics of the present invention will become more apparent from the following detailed description considered with reference to the accompanying drawing figures wherein.

DETAILED DESCRIPTION OF THE INVENTION

An embodiment of the present invention will be described hereinbelow in detail with reference to the accompanying drawings.

Figure 1:
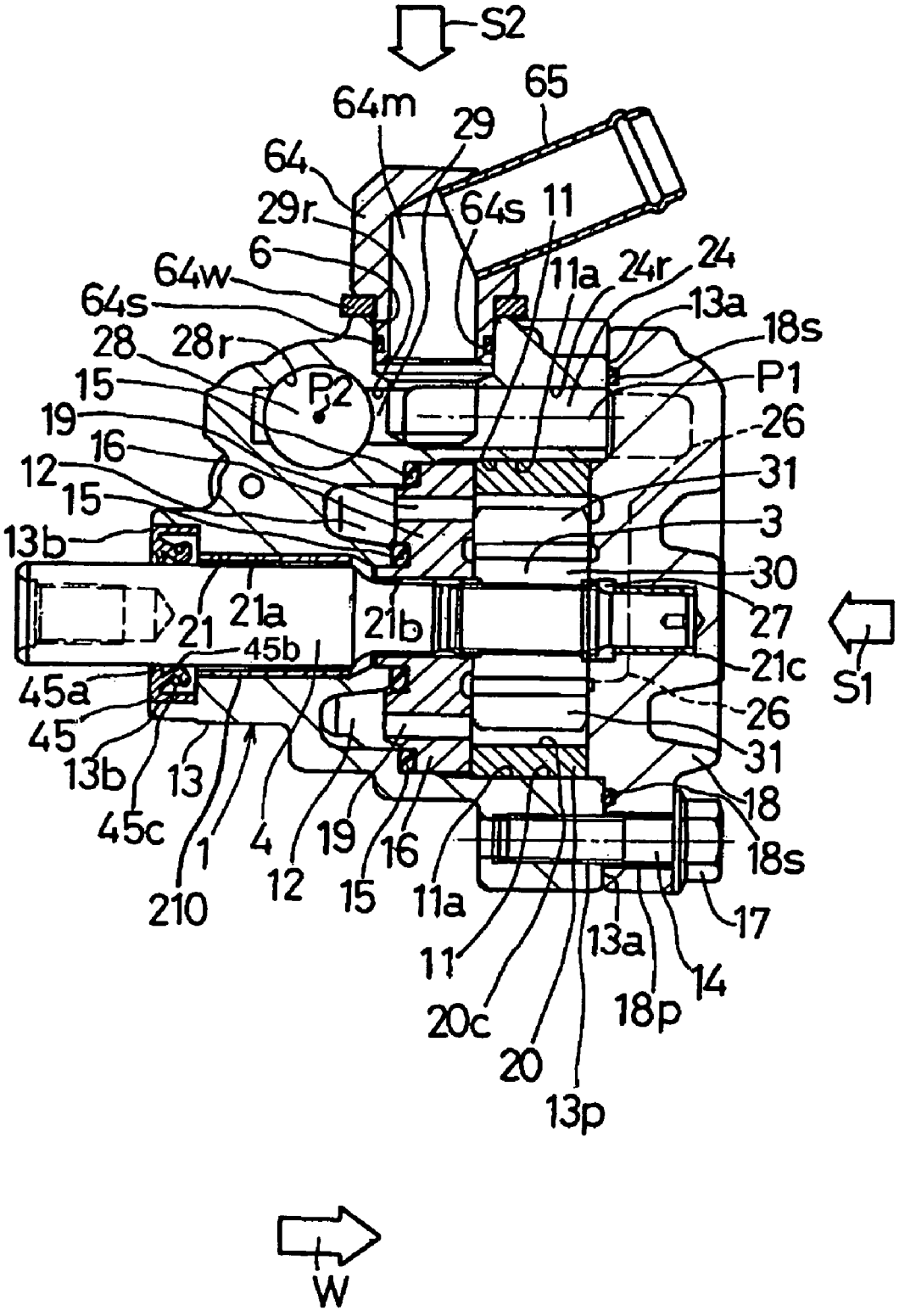
FIG. 1 is a cross-sectional view illustrating a vane type oil pump apparatus according to an embodiment of the present invention.

As illustrated in FIG. 1, a base portion 1 of an oil pump apparatus according to the embodiment of the present invention includes a housing 13, a first side plate 16, and a second side plate 18. The housing 13 houses two types of chambers, one is an operating chamber 11 defined by an inner peripheral surface 11*a*, and the other one is a discharging chamber 12 communicating with the operating chamber 11. The first side plate 16 is disposed in the operating chamber 11 via a ring-shaped sealing portion 15 so as to face the discharging chamber 12. The second side plate 18 is integrally fixed to a clamp surface 13*a* of the housing 13. More particularly, a clamp such as a fixing screw 14 passes through a passage hole 18*p* of the second side plate 18. The fixing screw 14 is screwed into a screw bore 13*p* of the housing 13. The second side plate 18 is detachably fixed to the clamp surface 13*a* of the housing 13 via a ring-shaped sealing portion 18*s*. Discharging ports 19 are defined substantially in parallel with an axial direction of the first side plate 16 and communicate with the discharging chamber 12 and the operating chamber 11. A cam ring 20 is disposed in the operating chamber 11 so as to be tightly held between the first side plate 16 and the second side plate 18.

As illustrated in FIG. 1, a shaft aperture 21 is defined in the base portion 1 so as to communicate with the operating chamber 11. The shaft aperture 21 includes a first shaft aperture 21*a*, which is defined in the housing 13 and possesses a relatively large diameter, a second shaft aperture 21*b*, which is defined in the first side plate 16 and possesses a relatively small diameter, and a third shaft aperture 21*c*, which is defined in the second side palate 18 and possesses a relatively small diameter.

Figure 2:
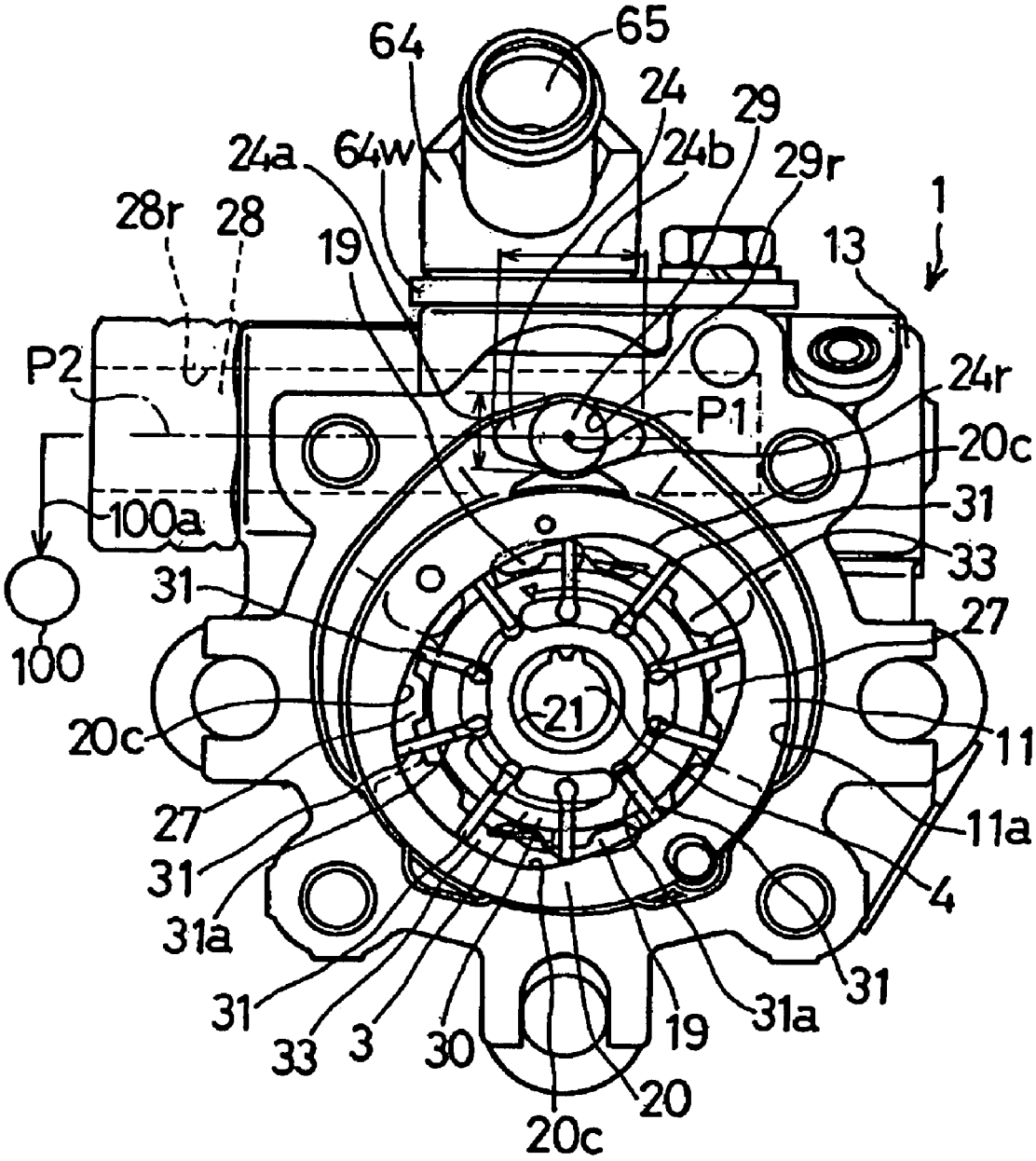
FIG. 2 is a side view illustrating the oil pump apparatus illustrated in FIG. 1 on the basis of a view indicated by an arrow S1, and the oil pump apparatus in FIG. 2 excludes a second side plate therefrom.
Figure 3A:
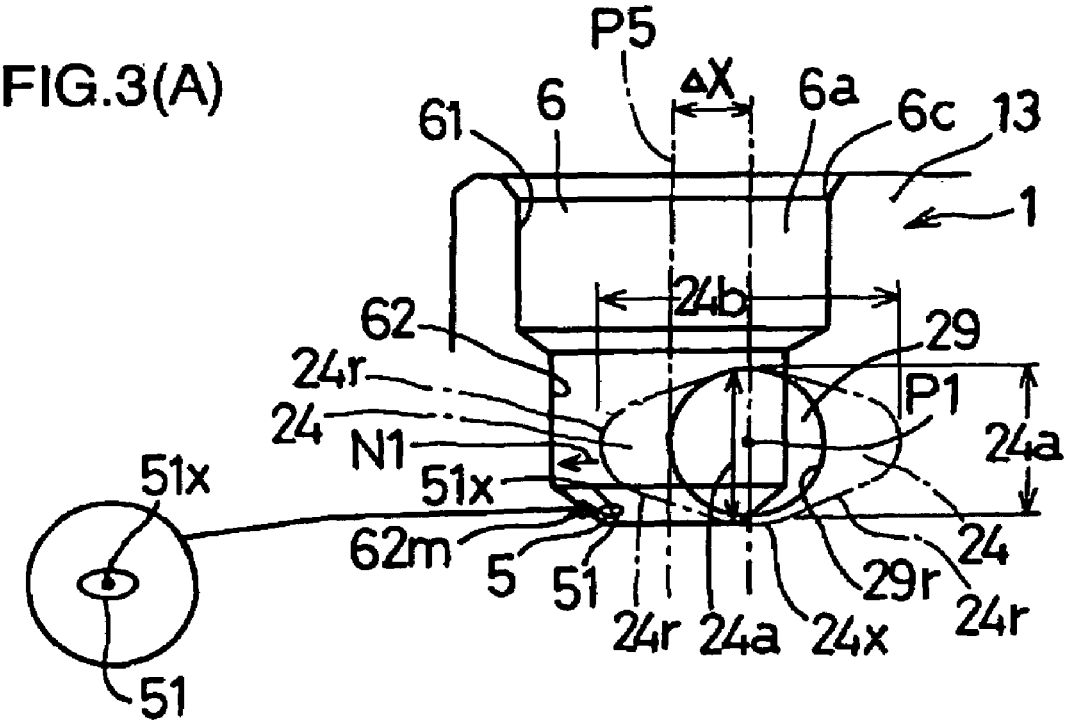
FIG. 3(A) is a sectional view illustrating somewhere around a suction hole according to the embodiment of the present invention.

As further illustrated in FIG. 1, a suction passage 24 is defined in the housing 13 of the base portion 1 in parallel with a central axis of the shaft aperture 21. The suction passage 24 communicates with suction ports 27 via a suction communicating passage 26 so as to supply oil to the suction ports 27. As illustrated in FIGS. 2 and 3(A), the suction passage 24 does not possesses a perfect circle cross-sectional shape but possesses an elliptic or oval cross-sectional shape with a major diameter 24*b* (i.e. a second diameter) and a minor diameter 24*a* (i.e. a first diameter). As illustrated in FIG. 2, the major diameter 24*b* extends in an extending direction of a central axis P2 of a discharged passage 28 (described later). The minor diameter 24*a* substantially intersects at right angle with the central axis P2 of the discharged passage 28.

As illustrated in FIG. 2, a rotor assembly (i.e. a rotating means) 3 is disposed in the operating chamber 11 for its rotation. More particularly, the rotor assembly 3 is disposed in the cam ring 20 for its rotation. The oil supplied to the suction ports 27 is discharged to the discharging chamber 12 via the discharging ports 19 and is further discharged to the discharged passage 28 along with rotation of the rotor assembly 3. That is, the rotor assembly 3 acts as a pump. The rotor assembly 3 includes a rotor 30 rotatable in the cam ring 20 and plural vanes 31 disposed in respective grooves 31*a* radially defined at an outer periphery of the rotor 30. Each vane 31 can be moved in inner and outer radial directions of the rotor 30. A cam surface 20*c* is defined at an inner peripheral surface of the cam ring 20. Plural chambers 33 are defined by the plural vanes 31*a* in the cam surface 20*c* of the cam ring 20. An outer end of each vane 31 is slidably moved at the cam surface 20*c*.

As illustrated in FIG. 1, the discharged passage 28 with an inner peripheral surface 28*r* is defined in the housing 13 of the base portion 1. The discharged passage 28 possesses a circular cross-sectional shape and communicates with the discharging chamber 12. The discharged passage 28 is defined in the housing 13 so as to communicate with the operating chamber 11 via the discharging chamber 12 and the discharging ports 19. Therefore, when the rotor assembly 3 rotates, the oil is supplied to the discharged passage 28 via the discharging ports 19 and the discharging chamber 12.

Figure 4A:
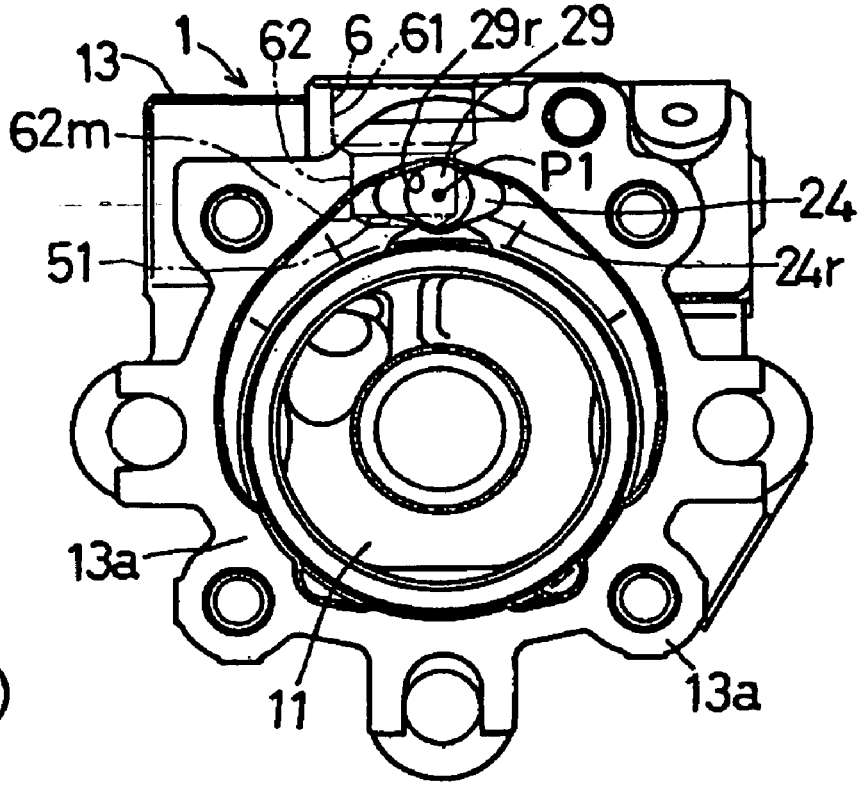
FIG. 4(A) is a side view of the oil pump apparatus illustrated in FIG. 1 on the basis of a view indicated by the arrow S1, and the oil pump apparatus illustrated in FIG. 4(A) excludes a first side plate, a cam ring, a rotor assembly, and the second side plate.
Figure 4B:
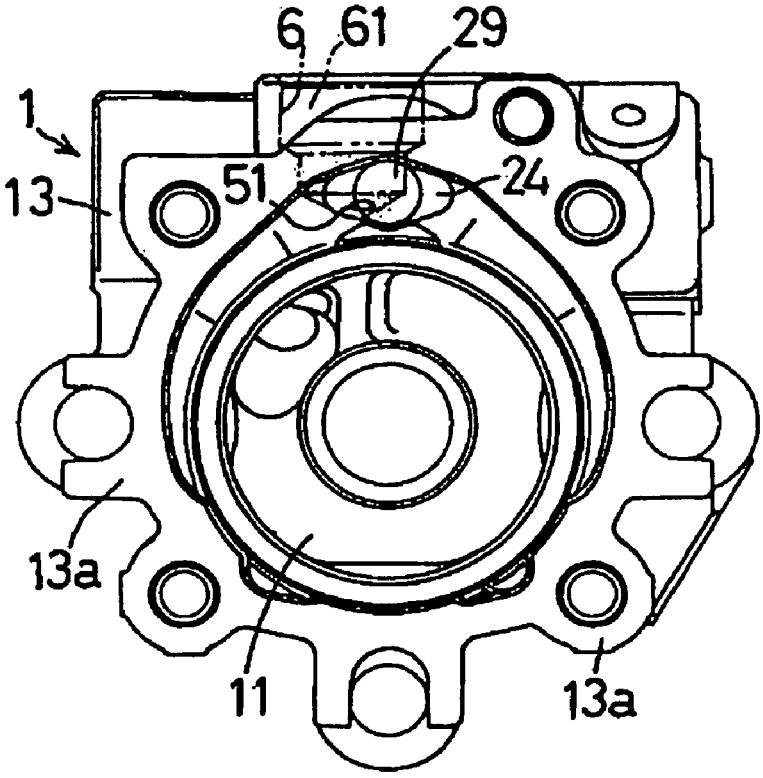
FIG. 4(B) is a side view illustrating an oil pump apparatus comparable with the oil pump apparatus illustrated in FIG. 4(A)

As illustrated in FIG. 1, the central axis P2 of the discharged passage 28 intersects with a central axis P1 of the suction passage 24. The discharged passage 28 communicates with the suction passage 24 via a bypass passage 29. The bypass passage 29 is defined by an inner peripheral surface 29*r* in the housing 13 and acts for returning excess oil supplied to the discharged passage 28 to the suction passage 24. A central axis of the bypass passage 29 extends coaxially with the central axis P1 of the suction passage 24 such that the bypass passage 19 communicates with the suction passage 24. A fluid cross-sectional area of the suction passage 24 is designed to be greater than a fluid cross-sectional area of the by pass passage 29, thereby enabling to assure an oil suction efficiency of the suction passage 24. As illustrated in FIGS. 2 and 3(A), the bypass passage 29 possesses a circular cross-sectional shape. An inner diameter of the bypass passage 29 is designed to be smaller than one of the suction passage 28 and to be smaller than the major diameter 24*b* of the suction passage 24, and yet is designed to be substantially the same as the minor diameter 24*a* of the suction passage 24. The bypass passage 29 is also illustrated in FIGS. 4(A), 5(A), and 6(A).

As illustrated in FIG. 1, a drive shaft 4 is held for its rotation by a metal bearing 210 disposed in the shaft aperture 21. The drive shaft 4 is integrally engaged within a bore of the rotor 30 such that the drive shaft 4 and the rotor assembly 3 can be integrally rotated. The rotor assembly 3 rotates in response to rotation of the drive shaft 4 connected to a crankshaft (not shown) of an engine. Therefore, when the drive shaft 4 rotates about a central axis thereof in response to rotation of the crankshaft, the rotor 30 and the vanes 31 are rotated in the same direction. In this case, the outer ends of the vanes 31 are slidably rotated along the cam surface 20*c*. Each chamber 33 connected to each suction port 27 is designed to possess a relatively large volume so as to surely attract the oil supplied to the suction ports 27. On the other hand, each chamber connected to each discharging port 19 is designed to posses a relatively small volume. The rotor assembly 3 is disposed in the housing 13 to possess a predetermined clearance between the first side plate 16 and a front end surface of the rotor assembly 3 and between the second side plate 18 and a rear end surface thereof. Both end surfaces of the rotor assembly 3 is slidably in contact with the first and second side plates 16 and 18 via oil films. Therefore, the oil can be leaked in a direction of the drive shaft 4.

As further illustrated in FIG. 1, disposed is a seal disposing portion 13*b* at a portion of the housing 13 facing the shaft aperture 21. A sealing means such as a ring-shaped sealing member (i.e. a sealing means) 45 is disposed at the seal disposing portion 13*b* so as to seal a boundary between an outer peripheral surface of the drive shaft 4 and an inner peripheral surface of the shaft aperture 21. Therefore, the oil can be effectively prevented from being leaked at the outer peripheral surface of the drive shaft 4. The sealing member 45 possesses a ring-shaped sealing portion 45*b* with a seal lip portion 45*a* and a ring-shaped spring 45*c* biasing the seal lip portion 45*a* in a radially inner direction of the shaft aperture 21 so as to enhance a sealing performance. Further, defined is an oil guiding groove (not shown) in an inner periphery of the metal bearing 210. The oil leaked at the outer peripheral surface of the drive shaft 4 is guided to the metal bearing 210 via the oil guiding groove.

Figure 5A:
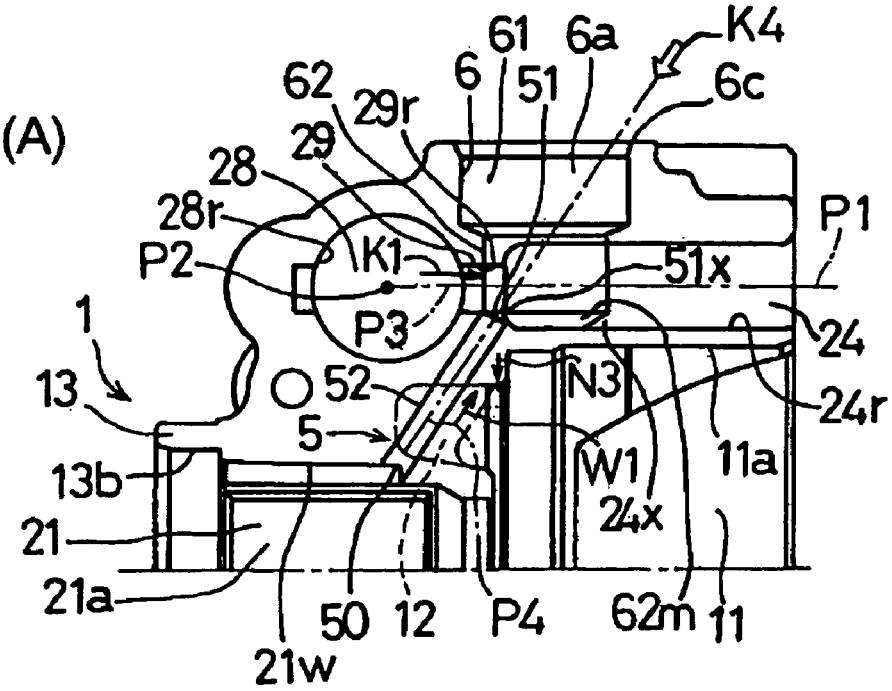
FIG. 5(A) is a sectional view illustrating somewhere around a drain bore according to the embodiment of the present invention.
Figure 6A:
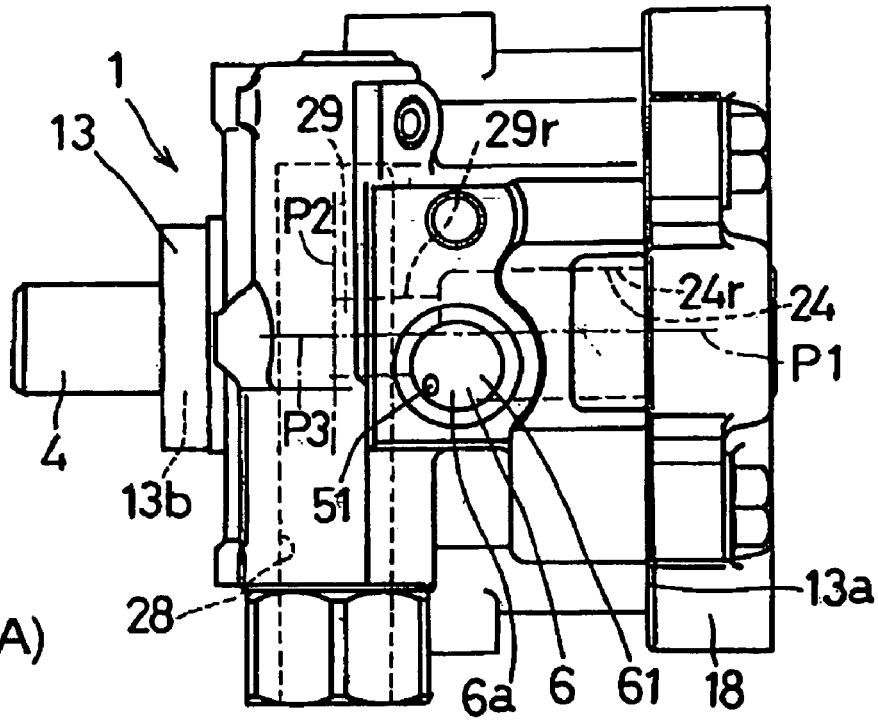
FIG. 6(A) is a view illustrating the oil pump apparatus illustrated in FIG. 1 on the basis of a view indicated by an arrow S2, and the oil pump apparatus illustrated in FIG. 6(A) excludes a suction portion.

As illustrated in FIG. 5(A), a drain bore 5 is defined in the housing 13 so as to drain the excess oil in the shaft aperture 21 to the suction passage 24, i.e. in a direction indicated by an arrow W1. An oil guiding passage 21*w* is defined at an outer periphery of the metal bearing 210 in the shaft aperture 21. The oil guiding passage 21*w* extends along an axial direction of the drive shaft 4 and one end thereof opens communicating with the sealing member 45. The drain bore 5 includes a drain inlet 50 communicating with the shaft aperture 21 via the oil guiding passage 21*w*, a drain outlet 51 communicating with the suction passage 24, and a drain connecting passage connecting the drain inlet 50 with the drain outlet 51. The drain inlet 50 communicates with the oil guiding passage 21*w* near the operating chamber 11 rather than the seal disposing portion 13*b*. Therefore, the oil leaked at the outer periphery of the drive shaft 4 during operation of the oil pump apparatus according to the embodiment of the present invention is introduced by the drain inlet 50 via the oil guiding groove and the oil guiding passage 21*w*. The introduced oil is conveyed in the direction indicated by the arrow W1 via the drain connecting passage 52 and is drained from the drain outlet 51.

The drain bore 5 is defined at a small zone between the discharged passage 28 and the operating chamber 11 in the housing 13 and possesses a small diameter. A central axis P4 of the drain connecting passage 52 intersects with the central axis P1 of the suction passage 24 and the central axis P2 of the discharged passage 28 with slopes relative the respective central axes. The central axis P4 of the drain connecting passage 52 extends to a radially inner side of an opening 6*a* of a suction hole 6 than an inner periphery 6*c* thereof. Therefore, the drain bore 5 can be defined in the housing 13 by inserting a cut drill in a direction indicated by an arrow K4 from the opening 6*a*.

As illustrated in FIG. 5 (A), the suction hole 6 is defined in hosing 13 so as to communicate with the suction passage 24 and the bypass passage 29. The suction hole 6 possesses a circular cross-sectional view. The suction hole 6 includes a first hole portion 61 possessing a relatively large inner diameter and a second hole portion 62 possessing a relatively small inner diameter. The first and second hole portions 61 and 62 are coaxially arranged. A conic surface 62*m* (i.e. an end surface) at a tip end of the second hole portion 62 reaches or faces a bottom portion 24*x* of the suction passage 24 at the operating chamber 11 side. The drain outlet 51 communicates with the surface 62*m* of the second hole portion 62.

The suction hole 6 is positioned above the operating chamber 11 and adjacent to the discharged passage 28 at FIG. 5(A). When the discharged passage 28 is supplied with the excess oil in response to the rotation of the rotor 3, a flow control valve 7 (illustrated in FIG. 7) disposed in the discharged passage 28 operates so as to return the excess oil in the discharged passage 28 to the suction passage 24 maintained at a relatively low pressure level via the bypass passage 29, i.e. in a direction indicated by an arrow K1. Therefore, the excess oil supplied to the discharged passage 28 is adjusted to an appropriate oil amount such that the oil with the appropriate oil amount can be supplied to a hydraulic equipment 100 (illustrated in FIG. 2).

A supercharge effect can be expected when the oil in the discharged passage 28 is returned to the suction passage 24 via the bypass passage 29. In the above described structure that the suction hole 6 is located adjacent to the discharged passage 28, the oil can be introduced to the suction passage 24 from the suction hole 6 with an enhanced suction efficiency. As illustrated in FIG. 3, a central axis P5 of the suction hole 6 possesses a space ΔX (i.e. a predetermined distance) relative to the central axis P1 of the suction passage 24, i.e. relative to the central axis of the bypass passage 29.

As illustrated in FIG. 1, the suction hole 6 is attached with a suction portion 64 having a suction cylinder 65 via a ring-shaped sealing portion 64*s* and a ring-shaped fixing portion 64*w*. When the rotor assembly 3 rotated along with the vanes 31 in response to the rotation of the crankshaft during the operation of the oil pump apparatus, the oil flows from the suction cylinder 65, a bore 64*m* of the suction portion 64, the suction passage 24, the suction communicating passage 26, the suction ports 27, the chambers 33, the discharging ports 19, the discharging chamber 12, the discharged passage 28, and the hydraulic pressure equipment 100.

Figure 7:
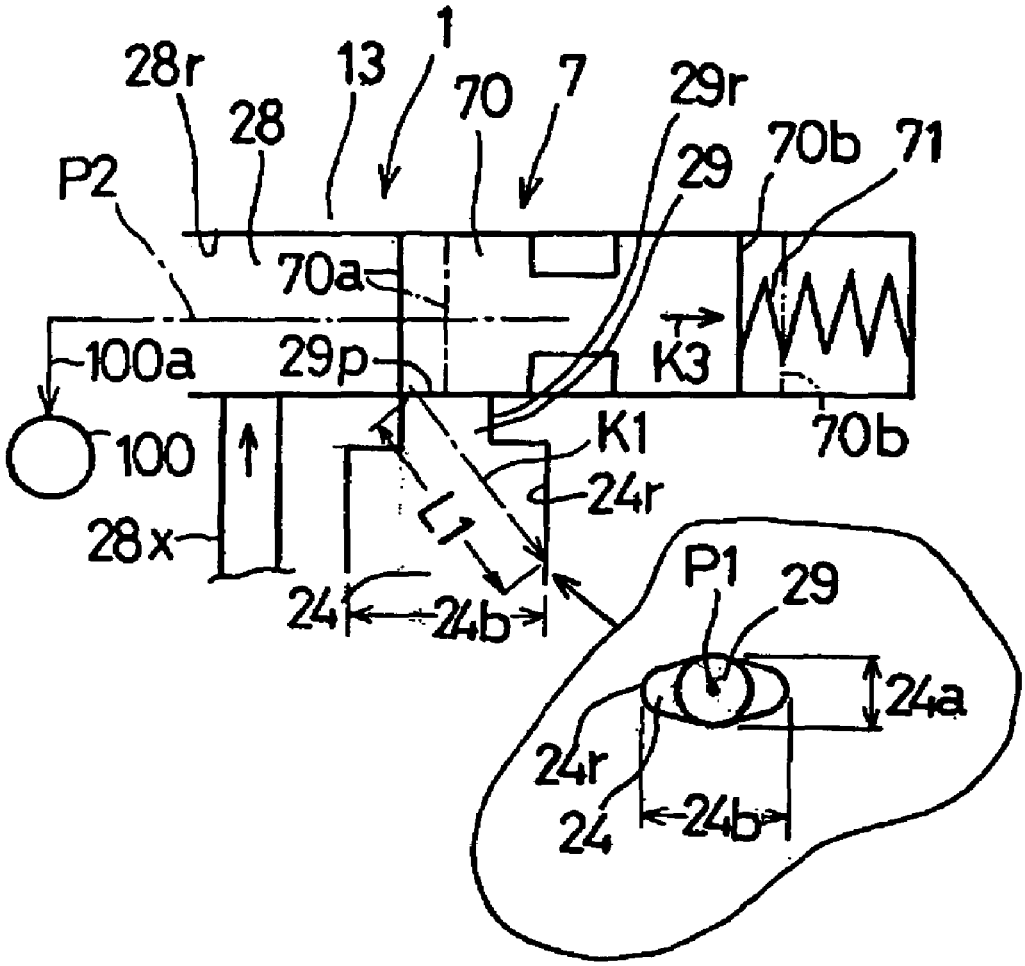
FIG. 7 is a conceptual diagram illustrating a flow control valve according to the embodiment of the present invention.

As illustrated in FIG. 7, the flow control valve 7 is employed for adjusting the amount of the oil in the discharged passage 28. The flow control valve 7 includes a spool 70 disposed in a reciprocable manner in the discharged passage 28 and a bias spring 71 for biasing the spool 70 in a direction for closing an inlet opening 29*p* of the bypass passage 29. The spool 70 includes a front end surface 70*a* and a rear end surface 70*b*. The oil in the discharging ports 19 and the discharging chamber 12 is supplied to the discharged passage 28 via a supply passage 28*x* defined in the housing 13. The oil is further supplied to the hydraulic equipment 100 via an oil passage 100*a*.

When the oil supplied to the discharged passage 28 exceed the appropriate oil amount, the spool 70 is moved in a direction indicated by an arrow K3, i.e. in a direction for elastically compressing the bias spring 71 with the pressure of the oil in the discharged passage 28, wherein an opening area of the inlet opening 29*p* of the bypass passage 29 is increased. Accordingly, the excess oil in the discharged passage 28 can be supplied to the suction passage 24 maintained at the relatively low pressure level via the bypass passage 29 in the direction indicated by the arrow K1. In this case, the oil from the discharged passage 28 can be appropriately supplied to the hydraulic equipment 100 via the oil passage 100*a*.

As described above, when the excess oil in the discharged passage 28 maintained at a relatively high pressure level is returned to the suction passage 24 maintained at the relatively low pressure level in the direction indicated by the arrow K1, the oil is generally returned in a fairly high return speed. Especially in the case that the oil pump apparatus has been designed to be able to generate a relatively high oil pressure and amount, an inside of the discharged passage 28 is maintained at a relatively high pressure level with a relatively large oil amount, wherein the oil is generally returned in a fairly high return speed.

As explained above, the suction passage 24 possesses the elliptic or oval cross-sectional shape with the major diameter 24*b* and the minor diameter 24*a*. As illustrated in FIG. 2, the major diameter 24*b* extends along the extending direction of the central axis P2 of the discharged passage 28. In this case, a distance L1 from the inlet opening 29*p* of the bypass passage 29 to an inner peripheral surface of the suction passage 24 can be designed to be longer than a distance therebetween of a suction passage 24 possessing a perfect circular cross-sectional shape. Therefore, the structure of the suction passage 24 according to the embodiment of the present invention is effective to absorb a direct contact of the returning oil with the suction passage 24.

FIG. 3(A) is a sectional view taken along an orthogonal direction relative to the central axis P1 of the suction passage 24, and shows the opening center 51*x* of the drain outlet 51.

As illustrated in FIG. 3(A), the opening center 51*x* of the drain outlet 61 is designed to be positioned outwardly from the inner peripheral surface 24*r* of the suction passage 24 or an extended line thereof. That is, the opening center 51*x* of the drain outlet 51 is defined in a direction indicated by an arrow N1 in FIG. 3(A) so as to be away from the central axis P1 of the suction passage 24. Therefore, in the case that when the oil pump apparatus has been designed to be able to generate a relatively high oil pressure and amount, the drained oil flow from the drain outlet 51 can be restrained from being affected by the oil flow from the discharged passage 28 to the suction passage 24 via the bypass passage 29.

Therefore, according to the embodiment of the present invention, a drain performance for draining the oil from the drain outlet 51 can be effectively restrained from being deteriorated. The oil leaked in the shaft aperture 21 can be hence surely drained from the drain outlet 51 via the drain inlet 50 and the drain connecting passage 52. Further, a pressure of the seal member 45 can be restrained from being increased, thereby enabling to restraining a early wear-out of the seal lip portion 45*a* of the seal member 45, and further enabling to restraining a drop-off of the seal member 45.

Figure 3B:
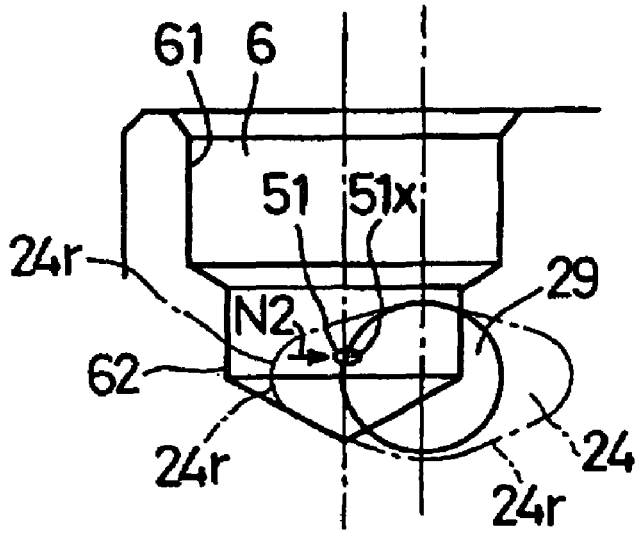
FIG. 3(B) is a sectional view illustrating somewhere around a suction hole of an oil pump apparatus comparable with the suction hole illustrated in FIG. 3 (A)

Comparing the oil pump apparatus with the above-described structure according to the embodiment of the present invention with a comparable oil pump apparatus illustrated in FIG. 3(B), the opening center 51*x* of the drain outlet 51 of the comparable oil pump apparatus is defined to be positioned inwardly from the inner peripheral surface 24*r* of the suction passage 24. That is, the opening center 51*x* of the drain outlet 51 is defined in a direction indicated by an arrow N2 in FIG. 3(B). Therefore, the oil drained from the drain outlet 51 can be easily affected by the oil flow into the suction passage 24. Therefore, especially when the oil pump apparatus has been designed to be able to generate a relatively high oil pressure and amount, the drain outlet 51 can be directly affected by the oil flow into the suction passage 24. In this case, the oil leaked at the shaft aperture 21 may not be appropriately drained from the drain outlet 51. As described above, when the oil leaked in the shaft aperture 21 can not be properly drained, the pressure in the shaft aperture 21 may be unnecessarily increased. Further, the seal lip portion 45*a* of the seal member 45 may be worn out earlier than expected. In this case, the seal member 45 may be dropped out of the seal disposing portion 13*b*.

FIG. 5(A) is a sectional view taken in parallel with the center axis P1 of the suction passage 24, and shows the opening center 51*x* of the drain outlet 51.

As illustrated in FIG. 5(A), an imaginary line P3 is defined to imaginably connect the central axis P2 of the discharged passage 28 and the central axis P1 of the suction passage 24. The opening center 51*x* of the drain outlet 51 is defined to be positioned at the shaft aperture 21 side, i.e. in a direction indicated by an arrow N3, so as to be away from the imaginary line P3. Therefore, the drain outlet 51 of the drain bore 5 can be effectively restrained from being affected by the oil flow into the suction passage 24. In this case, the oil can be surely drained from the drain outlet 51 to the suction passage 24, thereby enabling to restrain the pressure increase around the seal member 45, enabling to restrain early wear-out of the seal lip portion 45*a*, and enabling to restrain drop-off of the seal member 45.

Figure 5B:
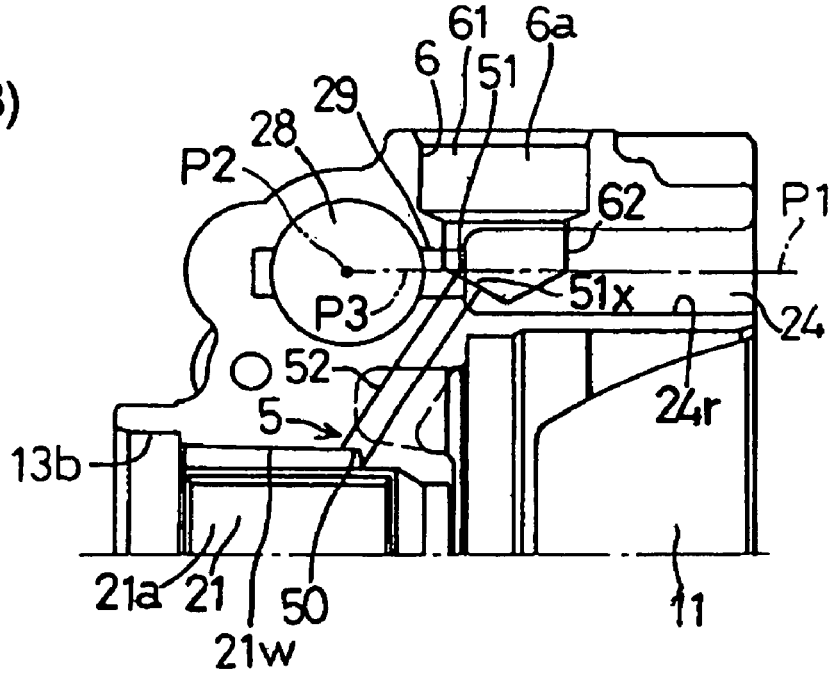
FIG. 5(B) is a sectional view illustrating somewhere around a drain bore of an oil pump apparatus comparable with the drain bore illustrated in FIG. 5(A)

Comparing the oil pump apparatus with the above-described structure according to the embodiment of the present invention with a comparable oil pump apparatus illustrated in FIG. 5(B), the opening center 51*x* of the drain outlet 51 of the comparable oil pump apparatus is defined to be overlapped on the imaginary line P3. In this case, the oil drained from the drain outlet 51 may be easily affected by the oil flow into the suction passage 24. Especially in the case that the oil pressure apparatus has been designed to be able to generate a relatively high oil pressure and amount, the oil may not be sufficiently able to be drained from the drain outlet 51. At this point, the sea lip portion 45*a* may be worn out earlier than expected. Further, the seal member 45 may be dropped out of the seal disposing portion 13*b*.

Figure 6B:
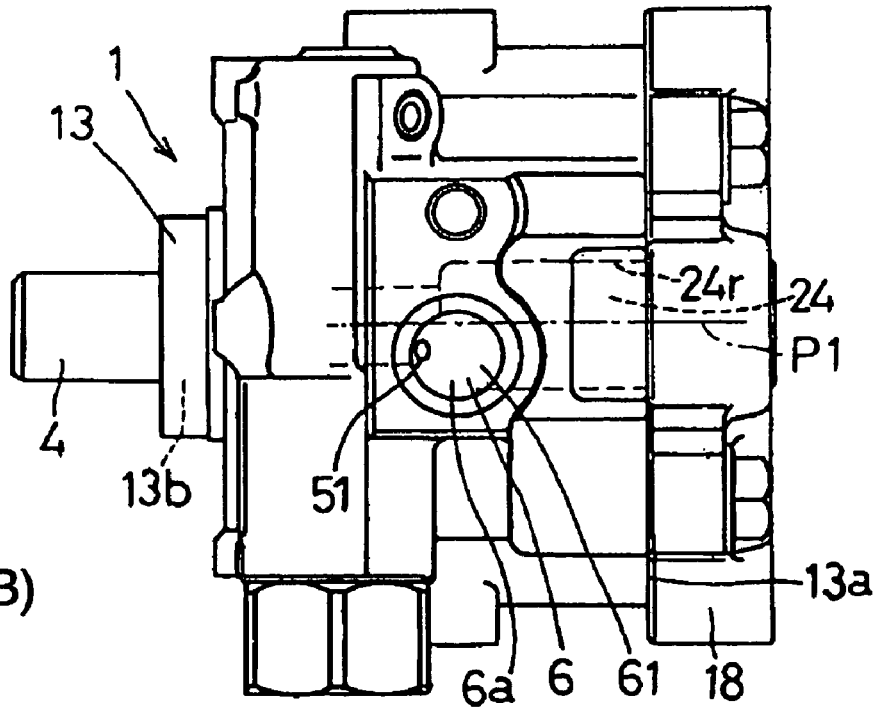
FIG. 6(B) is a view illustrating an oil pump apparatus comparable with the oil pump apparatus illustrated in FIG. 6(A)

As illustrated in FIG. 6 (A), the drain outlet 51 according to the embodiment of the present invention is designed to be fairly away from the central axis P1 of the suction passage 24 comparing with the drain outlet 51 of a comparable oil pump apparatus illustrated in FIG. 6(B).

As illustrated in FIG. 3(A), the opening center 51*x* of the drain outlet 51 is designed to be positioned outwardly from the inner peripheral surface 24*r* or the extension thereof. That is, the opening center 51*x* of the drain outlet 51 is defined in the direction indicated by the arrow N1 in FIG. 3(A) and is defined to be away from the central axis P1 of the suction passage 24.

As illustrated in FIG. 5(A), the opening center 51*x* of the drain outlet 51 is defined to be positioned at the shaft aperture 21 side.

According to the embodiment of the present invention, the drain outlet 51 of the drain bore 5 can be defined in any one of the above-described two manners or in a combined manner of the above-described two manners.

According to the embodiment of the present invention, the oil flows in the suction passage 24 along a direction indicated by an arrow W. The oil from the discharged passage 28 to the suction passage 24 via the bypass passage 29 flows in the same direction indicated by the arrow W.

According to the embodiment of the present invention, the drain outlet 51 faces a portion facing the suction passage 24 of the suction cylinder 6. Alternatively, the drain outlet 51 can face the only suction passage 24 or the only bypass passage 29.

According to the embodiment of the present invention, the vane type oil pump apparatus is employed as an oil pump apparatus. Alternatively, a gear oil pump apparatus can be applicable.

According to the embodiment of the present invention, the suction passage 24 possesses the elliptic or oval axial sectional shape with the major diameter 24*b* and the minor diameter 24*a*. Alternatively, the suction passage 24 can possess a perfect circular axial sectional shape.

As described above, the drain outlet 51 of the drain bore 5 is defined in any one of the above-described two manners (FIG. 3(A), or FIG. 5(A)) or in the combined manner of the above-described two manners. In this case, the drain outlet 51 can be defined to be away from the central axis P1 of the suction passage 24. Therefore, even when the oil pump apparatus has been designed to be able to generate a relatively high oil pressure and amount, the oil drained from the drain outlet 51 can be effectively restrained from being affected by the oil flow into the suction passage 24, thereby enabling to assure the oil drain performance from the drain outlet 51. In this case, the pressure of the seal member 45 can be effectively restrained from being increased, the seal lip portion 45*a* of the seal member 45 can be effectively restrained from being worn-out earlier than expected, and the sealing member 45 can be effectively restrained from being dropped off. This may be able to lead to improvement of a reliability of the oil pump apparatus.

The principles, preferred embodiment and mode of operation of the present invention have been described in the foregoing specification and drawings. However, the invention which is intended to be protected is not to be construed as limited to the particular embodiment disclosed. Further, the embodiment described herein is to be regarded as illustrative rather than restrictive. The plural objectives are achieved by the present invention, and yet there is usefulness in the present invention as far as one of the objectives are achieved. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. An oil pump apparatus comprising:

a base portion including:

an operating chamber;

a shaft aperture;

a suction port;

a discharging port;

a suction passage supplying an oil to the suction port; and a discharged passage discharging the oil from the discharging port;

a rotating means disposed in the operating chamber for its rotation and acting as a pump introducing the oil in the suction passage to the operating chamber via the suction port and supplying the oil to the discharged passage via the discharging port;

a drive shaft disposed in the shaft aperture for its rotation so as to rotate the rotating means;

a sealing means disposed in a boundary between an outer peripheral surface of the drive shaft and an inner peripheral surface of the shaft aperture so as to seal the boundary; and a drain bore including:

a drain inlet communicating with the shaft aperture;

a drain outlet communicating with the suction passage; and a drain connecting passage connecting the drain inlet and the drain outlet, wherein an excess oil in the shaft aperture is introduced from the drain inlet for draining the oil and is drained from the drain outlet via the drain connecting passage, wherein an opening center of the drain outlet is positioned outwardly from an inner peripheral surface of the suction passage, or from an extended line of the inner peripheral surface of the suction passage, as seen in an orthogonal direction relative to a central axis of the suction passage.

2. An oil pump apparatus comprising:

a base portion including:

an operating chamber;

a shaft aperture;

a suction port;

a discharging port;

a suction passage supplying an oil to the suction; and a discharged passage discharging the oil from the discharging port;

a rotating means disposed in the operating chamber for its rotation and acting as a pump introducing the oil in the suction passage to the operating chamber via the suction port and supplying the oil to the discharged passage via the discharging port;

a drive shaft disposed in the shaft aperture for its rotation so as to rotate the rotating means;

a sealing means disposed in a boundary between an outer peripheral surface of the drive shaft and an inner peripheral surface of the shaft aperture so as to seal the boundary; and a drain bore including:

a drain inlet communicating with the shaft aperture;

a drain outlet communicating with the suction passage; and a drain connecting passage connecting the drain inlet and the drain outlet, wherein an excess oil in the shaft aperture is introduced from the drain inlet for draining the oil and is drained from the drain outlet via the drain connecting passage, wherein an opening center of the drain outlet is positioned at a side of the shaft aperture relative to an imaginary line connecting a central axis of the discharged passage and a central axis of the suction passage, as seen in a direction parallel with the central axis of the suction passage, such that the opening center of the drain outlet is not overlapped on the imaginary line.

3. An oil pump apparatus comprising:

a base portion including:

an operating chamber;

a shaft aperture;

a suction port;

a discharging port;

a suction passage supplying an oil to the suction port; and a discharged passage discharging the oil from the discharging port;

a rotating means disposed in the operating chamber for its rotation and acting as a pump introducing the oil in the suction passage to the operating chamber via the suction port and supplying the oil to the discharged passage via the discharging port;

a drive shaft disposed in the shaft aperture for its rotation so as to rotate the rotating means;

a sealing means disposed in a boundary between an outer peripheral surface of the drive shaft and an inner peripheral surface of the shaft aperture so as to seal the boundary; and a drain bore including:

a drain inlet communicating with the shaft aperture;

a drain outlet communicating with the suction passage; and a drain connecting passage connecting the drain inlet and the drain outlet, wherein an excess oil in the shaft aperture is introduced from the drain inlet for draining the oil and is drained from the drain outlet via the drain connecting passage, wherein an opening center of the drain outlet is positioned outwardly from an inner peripheral surface of the suction passage or from an extended line of the inner peripheral surface somewhere around the opening center of the drain outlet exists so as to take along an orthogonal direction relative to a central axis of the suction passage, and wherein the opening center of the drain outlet is positioned at a side of the shaft aperture relative to an imaginary line connecting a central axis of the discharged passage and a central axis of the suction passage, as seen in a direction parallel with the central axis of the suction passage, such that the opening center of the drain outlet is not overlapped on the imaginary line.

4. An oil pump apparatus according to claim 1, further comprising:

a suction hole possessing a cylindrical shaped structure with an end surface facing the suction passage, wherein the opening center of the drain outlet is defined at the end surface of the suction hole.

5. An oil pump apparatus according to claim 4, wherein, a central axis of the suction hole deviates from the central axis of the suction passage with a predetermined distance therefrom.

6. An oil pump apparatus according to claim 1, wherein the opening center of the drain outlet is defined at the suction passage.

7. An oil pump apparatus according to claim 1, further comprising:

a bypass passage connecting the discharged passage and the suction passage, wherein the opening center of the drain outlet is defined at the bypass passage.

8. An oil pump apparatus according to claim 1, wherein the suction passage possesses an oval cross-sectional shape with a first diameter and a second diameter whose length is longer than that of the first diameter.

9. An oil pump apparatus according to claim 4, wherein a central axis of the drain connecting passage extends closer to a radially inner side of the suction hole than an inner periphery thereof.

10. An oil pump apparatus according to claim 2, further comprising:

a suction hole possessing a cylindrical shaped structure with an end surface facing the suction passage, wherein the opening center of the drain outlet is defined at the end surface of the suction hole.

11. An oil pump apparatus according to claim 2, wherein the opening center of the drain outlet is defined at the suction passage.

12. An oil pump apparatus according to claim 2, further comprising:

a bypass passage connecting the discharged passage and the suction passage, wherein the opening center of the drain outlet is defined at the bypass passage.

13. An oil pump apparatus according to claim 2, wherein the suction passage possesses an oval cross-sectional shape with a first diameter and a second diameter whose length is longer than that of the first diameter.

14. An oil pump apparatus according to claim 10, wherein a central axis of the drain connecting passage extends closer to a radially inner side of the suction hole than an inner periphery thereof.

15. An oil pump apparatus according to claim 3, further comprising:

a suction hole possessing a cylindrical shaped structure with an end surface facing the suction passage, wherein the opening center of the drain outlet is defined at the end surface of the suction hole.

16. An oil pump apparatus according to claim 15, wherein, a central axis of the suction hole deviates from the central axis of the suction passage with a predetermined distance therefrom.

17. An oil pump apparatus according to claim 3, wherein the opening center of the drain outlet is defined at the suction passage.

18. An oil pump apparatus according to claim 3, further comprising:

a bypass passage connecting the discharged passage and the suction passage, wherein the opening center of the drain outlet is defined at the bypass passage.

19. An oil pump apparatus according to claim 3, wherein the suction passage possesses an oval cross-sectional shape with a first diameter and a second diameter whose length is longer than that of the first diameter.

20. An oil pump apparatus according to claim 15, wherein a central axis of the drain connecting passage extends closer to a radially inner side of the suction hole than an inner periphery thereof.

* * * * *